US005511405A

United States Patent [19]

Kikuchi

[11] Patent Number: 5,511,405

[45] Date of Patent: Apr. 30, 1996

[54] SHUTTER MANUFACTURING METHOD

[75] Inventor: Shuichi Kikuchi, Miyagi, Japan

[73] Assignee: Sony Corporation, Tokyo, Japan

[21] Appl. No.: 235,978

[22] Filed: May 2, 1994

[30] Foreign Application Priority Data

May 11, 1993 [JP] Japan ..... 5-109099

[51] Int. Cl.[6] ..... B21D 28/06

[52] U.S. Cl. ..... 72/337; 72/339; 72/404

[58] Field of Search ..... 72/339, 335, 337, 72/330, 404; 83/50, 277

[56] References Cited

U.S. PATENT DOCUMENTS

| | | | |
|---|---|---|---|
| 3,765,217 | 10/1973 | Ikeda | 72/404 |
| 4,320,647 | 3/1982 | Kummeling | 72/334 |
| 5,021,913 | 6/1991 | Overland | 360/133 |
| 5,247,825 | 9/1993 | Erickson | 72/339 |

FOREIGN PATENT DOCUMENTS

| | | | |
|---|---|---|---|
| 184532 | 11/1982 | Japan | 72/404 |
| 223622 | 11/1985 | Japan | 72/337 |
| 165239 | 7/1986 | Japan | 72/404 |
| 170972 | 8/1986 | Japan | 360/139 A |
| 2233810 | 1/1991 | United Kingdom . | |

*Primary Examiner*—Daniel C. Crane

*Attorney, Agent, or Firm*—Ronald P. Kananen

[57] ABSTRACT

A method of manufacturing shutters for computer disks, optical disks and the like, includes forming a rib on a connecting member formed between adjoining shutter blanks during bending and cutting processing. The rib is concave in cross-section and increases a strength of the connecting portion such that stress applied during bending processing, and movement of the rolled steel which is used for manufacturing, does not deform the connecting portion. According to this, processing speed for manufacturing may be increased and further, thinner material may be utilized in forming the shutters. Also, at a later stage of processing, the convex ribs may again be flattened.

13 Claims, 5 Drawing Sheets

SHUTTER MANUFACTURING METHOD

BACKGROUND OF THE INVENTION

1. Field of The Invention

The present invention relates generally to a method of manufacturing shutters for floppy disc cartridges or the like. Specifically, the present invention relates to a shutter manufacturing method in which 2. Description of The Related Art Floppy discs, cassette cartridges and other types of cartridge-contained products utilize a shutter portion, generally made of metal, to cover an access opening of the cartridge when the cartridge is not in use.

Generally, such shutters are pressed from a roll of stainless steel plate. The stainless steel roll is pulled in a feeding direction and processed by a multistage (for example, process steps a–d) process including, for example, a punching step, cutting step, and so forth, to produce a plurality of shutters.

Referring to FIGS. 6(A), (B), a series of shutters prepared from a single sheet of stainless steel plate 2 according to such a conventional process is shown. In the drawing, successive shutter blanks 13*a–d* are shown in different stages of processing. As may be seen, in step a, a pilot hole 10 and a slide hook opening 11 are formed in the steel plate 2. In step b, a shutter spring hook opening 12 is formed. Then, in step c, the shape of the shutter blank 13 is cut and a remaining connecting portion 14 is formed between the successively formed shutters on tile steel plate 2 and, in step d, shutter access openings 15, 15 are formed.

Then, a first step a of bending processing is performed such that protruding portions of the slide hook opening 11 and the shutter spring hook opening 12 are bent so as to form a slide hook 16 and a shutter spring hook 17 and a protruding portion of the shutter access opening 15 is also bent. Then in a step b of bending processing, the shutter blank 13 is bent into the final shape of the shutter 6, that is, approximately a reverse C-shape. Finally, the connecting portion 14 is removed from between the shutters 6 formed continuously along the steel plate 2 and the process is complete.

However, according to such a process as set forth above, the connecting portion 14 is subject to a large amount of stress during movement of the steel plate 2 in the feeding direction, which may cause the connecting portion to bend as shown in FIG. 7, for example. According to this phenomenon, it is not possible to significantly raise a processing speed of a manufacturing line. Also, a thickness of the steel plate 2 used for manufacturing cannot be reduced.

Also, the shutters may be formed by such a method in which, after the shutter blanks 13 and connecting portions 14 are formed, the fully processed steel plate 2 is moved to another location for bending processing by a method in which a bending member is aligned continuously along a center line of the steel plate 2, corresponding to the position of the connecting members 14 for bending a plurality of shutter blanks into finished shutters 6 in a single step. However, according to this type of processing, the same problems as mentioned above are encountered.

Thus, the present invention is proposed to increase strength and durability of the connecting portion to allow shutters to be processed at a faster speed using thinner materials.

SUMMARY OF THE INVENTION

It is therefore a principal object of the present invention to overcome the drawbacks of the related art.

It is a further object of the present invention to provide a method of manufacturing cartridge shutters in which a processing speed of manufacturing may be raised while allowing a thinner material to be used for production.

In order to accomplish the aforementioned and other objects, a method of manufacturing a plurality of shutters is provided, comprising the steps of: feeding an elongate metal sheet in a given feeding direction; applying punching processing to the metal sheet to successively form a plurality of shutter blanks along a length thereof, each of the shutter blanks being connected by a connecting portion; forming a concave rib between ends of the connecting portions where the ends adjoin adjacent shutter blanks; applying bending processing successively to the shutter blanks for establishing a final configuration for the shutters; and removing the connecting portions.

According to another aspect of the invention, a method of forming shutters by a mid-point forming bending processing is provided, comprising the steps of: feeding an elongate metal sheet in a given feeding direction; applying punching processing to the metal sheet to successively form a plurality of shutter blanks along a length thereof, each of the shutter blanks being connected by a connecting portion; forming a concave rib between ends off the connecting portions where the ends adjoin adjacent shutter blanks; transporting the plurality of shutter blanks to a bending processing location; applying bending processing simultaneously to the plurality of shutter blanks for establishing a final configuration therefor; and removing the connecting portions.

Also, according to yet another aspect of the present invention, a plurality of shutter blanks is provided, comprising: connecting portions provided between each pair of adjoining shutter blanks, the connecting portions having a concave shape between first and second sides, as well as first and second ends thereof.

DESCRIPTION OF THE PREFERRED EMBODIMENT

Figure 1A:
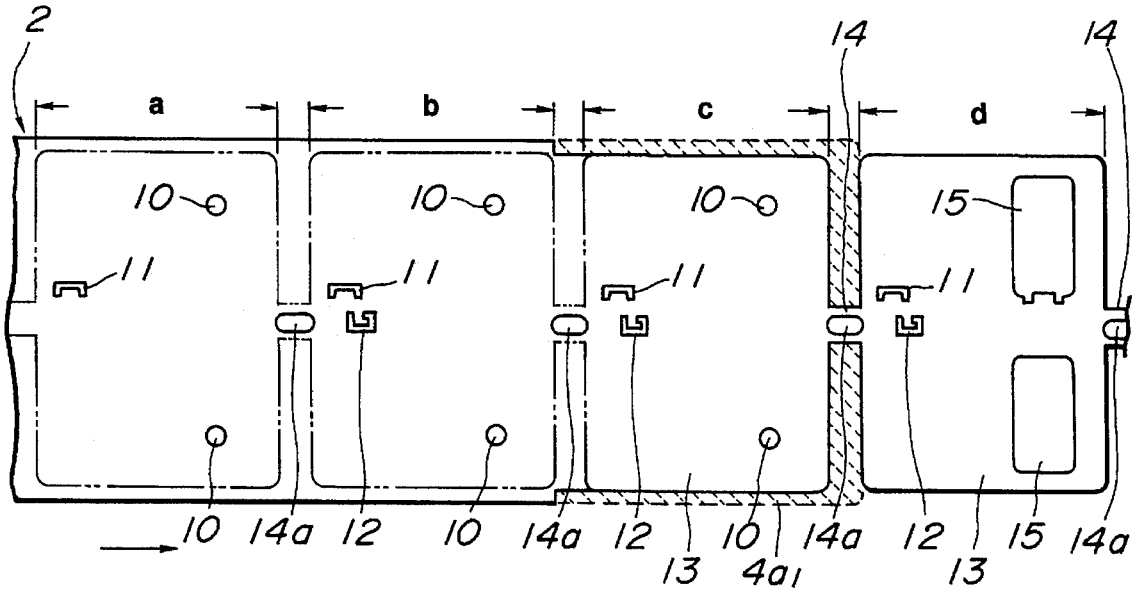
FIGS. 1(A) and (B) show a base plate and shutter portions formed therefrom according to a first preferred embodiment of the invention.
Figure 1B:
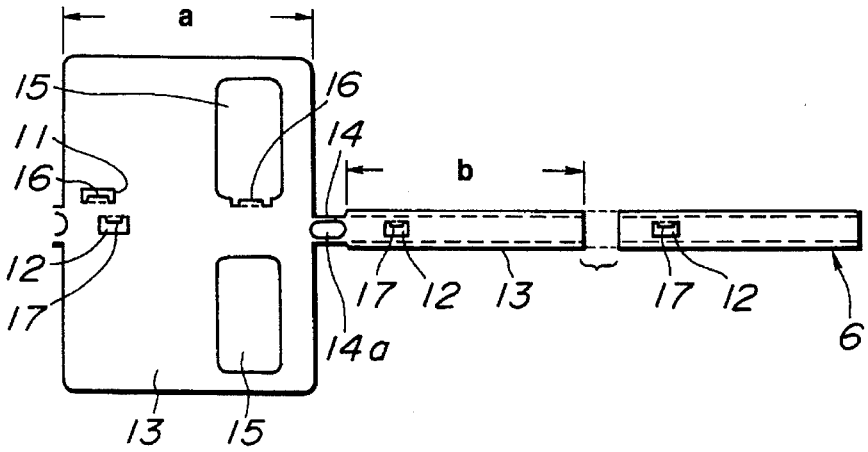

Referring now to the drawings, particularly to FIGS. 1–4, a first preferred embodiment of the invention will be described in detail hereinbelow.

Figure 2:
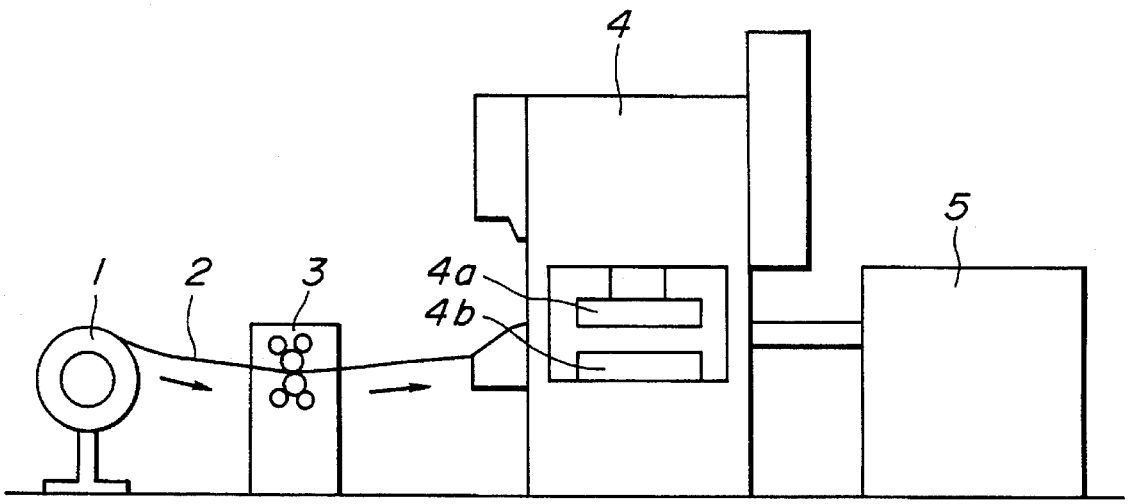
FIG. 2 is a simplified diagram of a manufacturing assembly for forming cartridge shutters according to the invention.
Figure 3A:
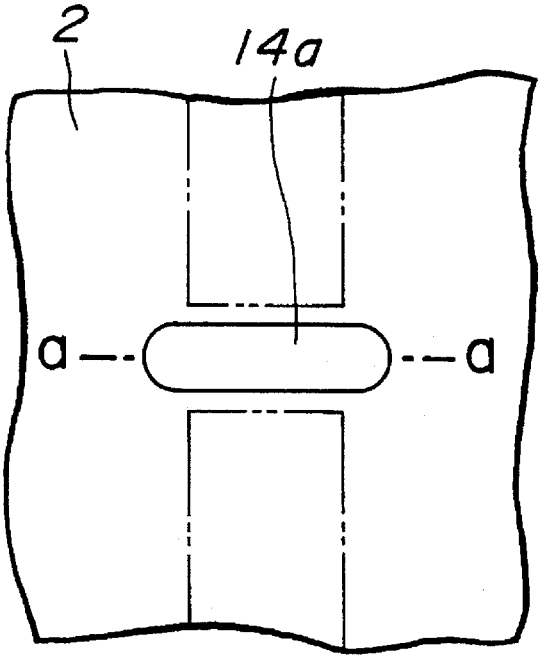
FIG. 3(A) shows a connecting portion formed between shutters according to the method of the invention.
Figure 3B:
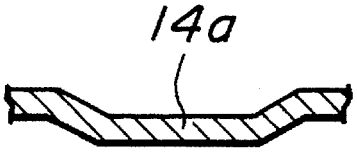
FIG. 3(B) is a cross-sectional view showing a configuration of the connecting portion, taken along line a—a of FIG. 3(A)

Referring now to FIG. 2, a system assembly for manufacturing cartridge shutters according to the invention is shown. As may be seen in the drawing, a reel stand 1 rotatably mounts a roll of stainless steel plate 2. The leading edge of the roll of stainless steel plate 2 is fed through a shape correction mechanism 3 and then through a pressing mechanism 4. The roll of stainless steel plate 2 is then fed to an aligning mechanism 5 after having been pressed into shutters 6 at the pressing mechanism 4.

The pressing mechanism 14 utilizes a punch 4*a* and a die 4*b* to produce a shutter 6 as will be explained hereinbelow with reference to FIG. 3. As some steps of the process and portions of the shutters 6 are identical to the conventional process, like reference numbers will be used to refer to like parts and only portions of the process related to the invention will be explained in detail since other aspects of the process have been detailed in relation to the prior art.

Referring to FIGS. 1(A), (B), according to the present embodiment, in steps a and b, a pilot hole 10, a slide hook opening 11 and a shutter spring 17 are formed in the steel plate 2, as with the conventional method. Then a rib 14*a* is formed in the connecting portion 14 between the shutter blanks 13 of the steel plate 2. The rib 14*a* is shown in detail in FIGS. 3(A) and 3(B) and, as may be seen in FIG. 3(B), the rib has a concave shape in cross-section. After forming, each side of the connecting portion 14 meets sides of corresponding shutter blanks 13, 13 on each side thereof. Then, after step c of punch and die processing, the connecting portions 14 are formed between each pair of shutter blanks 13, 13. After this, the steel plate 2 is moved according to further processing thereof. At this time, due to the relatively small cross-sectional dimension of the steel plate 2, at a cross-sectional secondary moment, the connecting portions 14 are subject to a large amount of stress (i.e. more than 10×). However, owing to the formation of the convex rib, large deformation of the connecting portion 14, as occurs in the conventional process is prevented. According to this, processing speed and material thinness may be increased since the strength and bending resistance of the connecting portion is significantly increased.

After this, during cutting processing, the concave rib 14*a* may be pressed flat once again.

Figure 4:
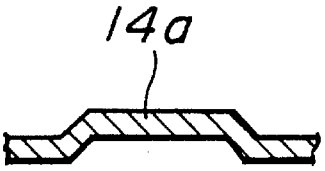
FIG. 4 shows a cross-sectional view of a rib according to the method of the invention.

Further, as seen in FIG. 4, the rib 14*a* may optionally be made convex in cross-section with an equally favorable result.

Figure 5:
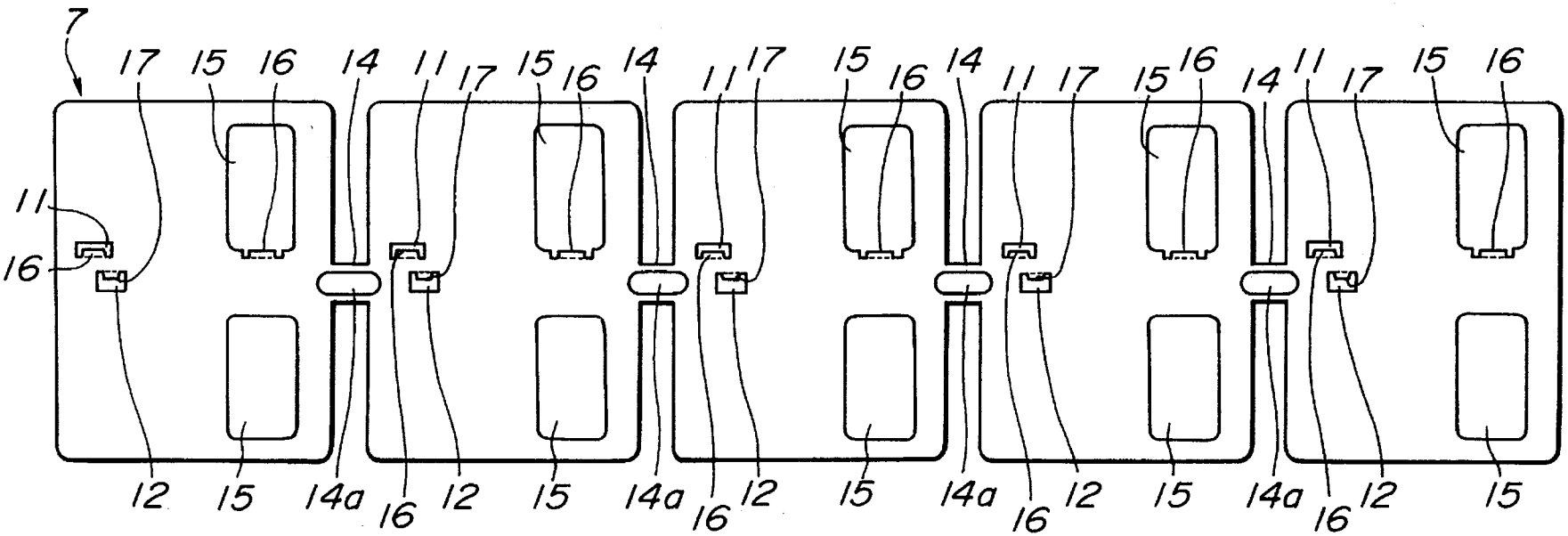
FIG. 5 is a cross-sectional view of a mid-point determining plate according to a second embodiment of the invention.
Figure 6A:
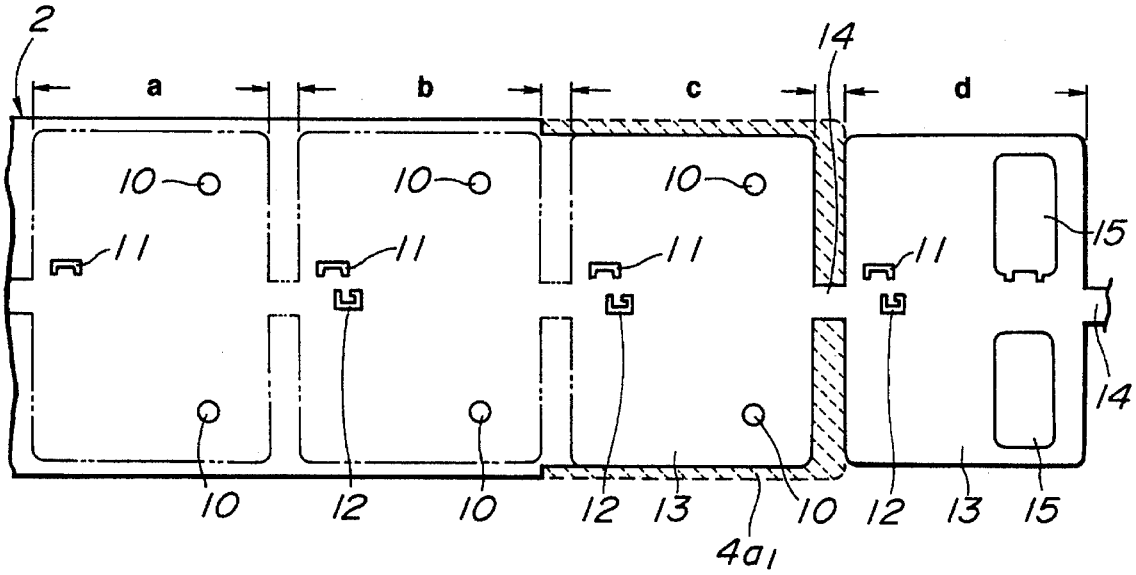
FIGS. 6(A) and (B) shows an example of cartridge shutters formed according to the conventional process.
Figure 6B:
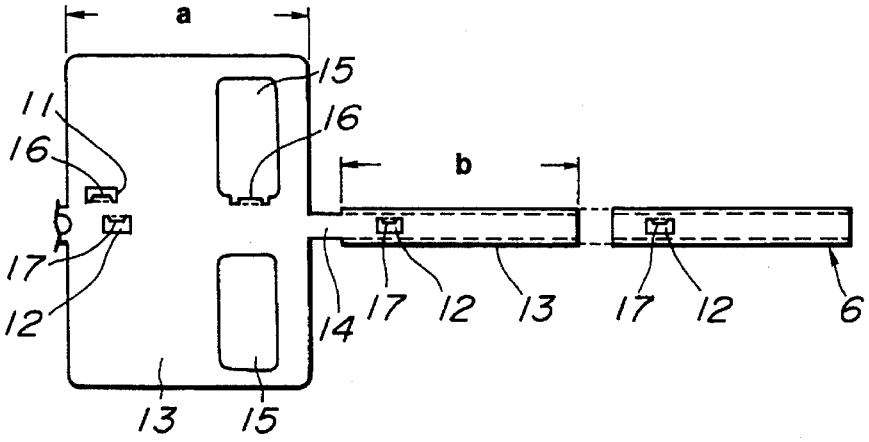
Figure 7:
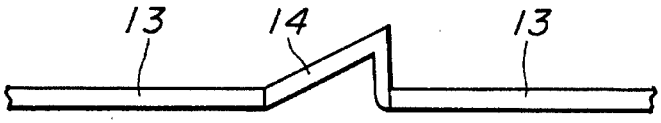
FIG. 7 shows a cross-sectional view of the configuration of a connecting portion according to the conventional method.

FIG. 5 shows a second embodiment according to the invention. According to this embodiment, a mid-point generation plate 7 is subject to punch and die processing at a first location where cutting and forming of the rib 14*a* is carried out. Then, the mid-point generation plate 7 is transferred to another location, for example another factory for bending. At this, the entire mid-point generation plate including the adjoining shutter blanks 13 formed thereon are subject to bending at one time to simultaneously form a plurality of shutters, cutting processing for separating the connected shutters may also be carried out at this stage.

Thus according to the above-described first and second embodiments, tile provision of the rib 14*a* on the connection portions 14 of adjoining shutters 6 is effective for increasing the strength of the connecting portions 14 allowing a processing speed to be increased and thinner metal plate to be used for manufacture whether bending processing is carried out consecutively along with cut and pressing processing or if bending processing is carried out separately in a single process at a different location.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A method of forming a plurality of shutters, comprising the steps of:

feeding an elongate metal sheet in a given feeding longitudinal direction;

applying punching processing to said metal sheet to successively form a plurality of shutter blanks having a length thereof in said longitudinal direction, each of said shutter blanks having a forward edge and a rearward edge extending about transverse to the length, said rearward edge of a first shutter blank being connected at an end of a connecting portion having an opposite end connected to a forward edge of a second adjacent shutter blank, said connecting portion having first and second longitudinal sides intermediate opposed edges of said adjacent shutter blanks;

forming a reinforcing rib between said ends of said connecting portions where said ends adjoin adjacent shutter blanks;

applying bending processing successively to said shutter blanks for establishing a final configuration of said shutters;

removing said connecting portions; and further including, at a time prior to said step of removing, a step of pressing said reinforcing rib flat.

2. A method as set forth in claim 1, wherein the step of forming said reinforcing rib in said connecting portion occurs at or before the time of step of punching processing.

3. A method as set forth in claim 1, wherein said step of forming said rib forms said reinforcing rib to be either concave or convex.

4. A method as set forth in claim 1, wherein a position of said first and second longitudinal sides of said connecting portions corresponds to lines along which said bending processing is carried out.

5. A method as set forth in claim 4, wherein said reinforcing rib portion is formed at the time of punching processing or at a time therebefore.

6. A method as set forth in claim 4, wherein said rib is formed to be either concave or convex.

7. A method as set forth in claim 4, wherein a position of first and second longitudinal sides of said connecting portions corresponds to lines along which said bending processing is carried out.

8. A method as set forth in claim 1 wherein said reinforcing rib is concave in shape so that large deformation of the connecting portion is prevented, so that processing speed and material thinness may be increased since the strength and bending resistance of the connection portion is increased by said concave rib.

9. A method as set forth in claim 1 wherein said reinforcing rib is convex in shape so that large deformation of the connecting portion is prevented, so that processing speed and material thinness may be increased since the strength and bending resistance of the connection portion is increased by said convex rib.

10. A method as set forth in claim 1 further including the steps of providing a rotatably mounted roll of metal plate; feeding a leading edge of the roll of metal plate through a shape correction mechanism; feeding said roll of metal plate from said shape correction mechanism to a pressing mechanism for pressing said metal plate into shutter blanks; and feeding said roll of metal plate to an aligning mechanism.

11. A method as set forth in claim 10 further including the steps of forming a pilot hole, a slide hook opening, and a shutter spring in the metal plate; then forming said connecting portion between adjacent shutter blanks.

12. A method as set forth in claim 10 wherein said metal plate is stainless steel.

13. In a method of forming shutters by midpoint forming bending processing, comprising the steps of:

feeding an elongate metal sheet in a given longitudinal feeding direction;

applying punching processing to said metal sheet to successively form a plurality of shutter blanks having a length thereof in said longitudinal feeding direction, each of said shutter blanks having a forward edge and a rearward edge extending about transverse to the length thereof, said rearward edge of a first shutter blank being connected at an end of a connecting portion having an opposite end connected to a forward edge of a second adjacent shutter blank, said connecting portion having first and second longitudinal sides intermediate opposed edges of said adjacent shutter blanks;

forming a reinforcing rib between said ends of said connecting portions where said ends adjoin adjacent shutter blanks;

transporting said plurality of shutter blanks to a bending processing location;

applying bending processing simultaneously to said plurality of shutter blanks for establishing a final configuration therefor;

removing said connecting portions; and wherein after said transporting step, the step of pressing processing is performed for flattening said reinforcing rib portion.

* * * * *